United States Patent [19]

Penney

[11] Patent Number: 4,530,121

[45] Date of Patent: Jul. 23, 1985

[54] TILTING BATH WITH PIVOTAL USER SEAT

[76] Inventor: Edison P. Penney, 3750 Underwood, Houston, Tex. 77025

[21] Appl. No.: 616,133

[22] Filed: Jun. 1, 1984

[51] Int. Cl.[3] ..... A47K 3/062

[52] U.S. Cl. ..... 4/540

[58] Field of Search ..... 4/540, 560, 561-566, 4/555, 558, 578, 579, 590, 559

[56] References Cited

U.S. PATENT DOCUMENTS

| | | | |
|---|---|---|---|
| 2,514,848 | 7/1950 | Davis | 4/540 |
| 2,536,540 | 1/1951 | Davis | 4/540 |
| 2,697,475 | 12/1954 | Dueth | 4/566 |
| 3,104,399 | 9/1963 | Dalton | 4/562 |
| 3,174,160 | 3/1965 | Fielding | 4/540 |
| 3,714,672 | 2/1973 | Condon | 4/563 |
| 3,852,835 | 12/1974 | Whitaker | 4/562 |
| 3,918,108 | 11/1975 | Feyerherm | 4/563 |
| 3,924,278 | 12/1975 | Ekman | 4/540 |
| 4,128,904 | 12/1978 | Ekman et al. | 4/540 |

*Primary Examiner*—Stephen Marcus
*Assistant Examiner*—Leo J. Peters
*Attorney, Agent, or Firm*—Gunn, Lee & Jackson

[57] ABSTRACT

A tilting bath including a support structure to be secured to the floor of a building. A bathtub is pivotally interconnected at one end thereof with the support structure and is provided with a user seat assembly which is pivotally secured to the bathtub and functions in gimbal-like manner to permit user seating during pivotal movement of the tub. Hydraulic cylinders are utilized to raise and lower the tub between its horizontal and upstanding positions. The bathtub incorporates flexible water supply and drain conduits for connection with a water supply and drain system of the building structure. Water supply, water draining and tub positioning are controlled by a user seated in the user seat assembly.

7 Claims, 4 Drawing Figures

TILTING BATH WITH PIVOTAL USER SEAT

FIELD OF THE INVENTION

This invention relates generally to bath systems for use by persons with infirmities to permit such persons to bathe themselves or to permit ease of patient bathing in hospitals, rest homes and other institutional facilities.

BACKGROUND OF THE INVENTION

In many cases, elderly persons or persons with infirmities are unable to bathe themselves in a domestic environment because they cannot readily get into or out of conventional fixed bathtubs. In such cases these persons must rely upon assistance for bathing activities and frequently must wait until assistance is available for bathing or bathe at the convenience of others. It is, therefore, desirable to provide a bath system which will enable a user of even limited mobility to enter and exit a bathtub easily and safely and accomplish bathing activities.

It is well known that the bath area of homes and institutions is one of the more dangerous areas of the building. Many objects in the bath are composed of porcelain or other hard materials to insure efficiency of cleaning and to withstand the detrimental effects of water, detergents, etc. Many persons are injured due to falls in bathrooms such as by slipping in bathtubs and on hard surfaced floors in the presence of water and cleaning products which render them slick. Especially under conditions where persons have infirmities that render them when walking, the hard, slick surfaces of bathrooms can be extremely dangerous. Since many falls and injuries occur while persons are in or about bathtubs it is desirable to provide a bath system capable of use by persons with infirmities which permits efficient and safe use by such persons.

SUMMARY OF THE INVENTION

It is therefore a primary feature of the present invention to provide a novel bath system which may be entered, used and exited by persons with infirmities in safe and efficient manner.

It is also a feature of this invention to provide a novel bath system which is positioned in upstanding manner for entry and exiting and is pivotal to a horizontal position for use.

It is an even further feature of this invention to provide a novel bath system incorporating a pivotal seat permitting a person to be seated with the bathtub in its upright position and remain seated during pivotal movement of the bathtub to its horizontal position for use.

It is another feature of this invention to provide a novel bath system which may be efficiently operated by the user person even though that person may have infirmities ordinarily rendering the person incapable of normal bathing activities.

It is also a feature of this invention to provide a novel bath system which is of simple nature, is reliable in use and low in cost.

THE PRIOR ART

It has long been recognized that the bathing needs of infirm persons need be provided for. In the past, a number of mechanized bathing systems have been developed. For example, U.S. Pat. No. 2,536,540 of Davis illustrates a walk-in bathtub which is pivotal intermediate its extremities and positionable between upstanding and horizontal positions. U.S. Pat. No. 2,514,848 of Davis discloses a similar walk-in type pivoted bathtub with a different mechaincal operating mechanism as compared to that shown in the "540" patent of Davis. U.S. Pat. No. 3,174,160 of Fielding discloses a tilting bath system which is operated hydraulically and incorporates controls which are positioned for access by a user either in a standing position for bathtub entry or a sitting position during bathtub use.

Briefly, the present invention takes the form of a bathtub which is positionable in upstanding manner where a user person may walk into it. The bathtub incorporates a pivotal seat structure enabling that person to become seated immediately upon entry of the bathtub and further enables the person to be safely secured in the seat. The person will then activate a hydraulic system interconnected between a floor mounted support structure and the bathtub thereby lowering the bathtub to its substantially horizontal position for use. During such lowering, the support chair supports the user person in gimbal-like manner so that the seat portion of the seat assembly remains substantially horizontal or at a desired position during bathtub transition. The bathtub structure is formed to define a bottom recess receiving the lower portion of the seat structure such that it is positioned in coextensive relation with the bottom surface of the bathtub. During use, the back support portion of the seat structure may be pivoted downwardly into the bottom recess to also become positioned in substantially co-extensive relation with the bottom surface of the tub. This feature permits the user person to move about in the tub after the bathtub has been lowered to its substantially horizontal position for use. The bathtub structure incorporates flexible water supply and drain conduit sections for connection with water supply and drain conduit systems of the building structure. It also incorporates water supply, water drain and bathtub mobility controls which are readily accessible by a person sitting in the seat structure of the bathtub.

BRIEF DESCRIPTION OF THE DRAWINGS

So that the manner in which the above recited features, advantages of objects of the present invention will become apparent and can be understood in detail, more particular description of the invention briefly summarized above may be had by reference to the embodiment thereof which is illustrated in the appended drawings, which drawings form a part of this specification.

It is to be noted, however, that the appended drawings illustrate only a typical embodiment of this invention and are therefore not to be considered limiting of its scope, for the invention may admit to other equally effective embodiments.

Figure 1:
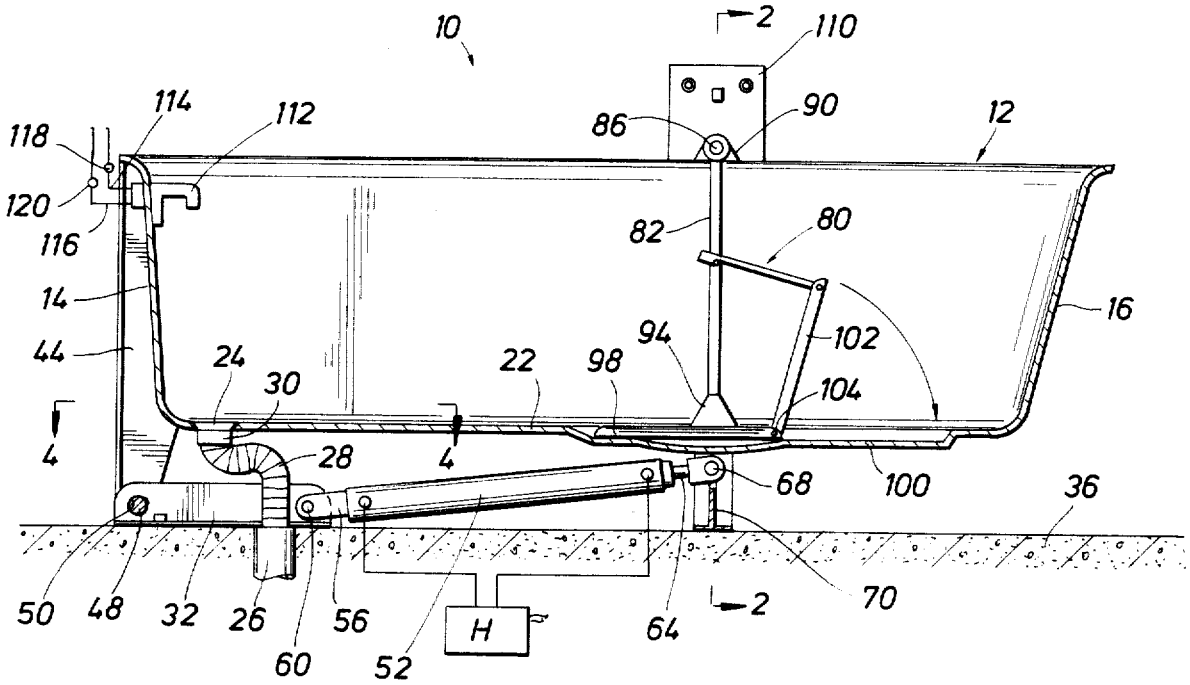

IN THE DRAWINGS:

FIG. 1 is sectional view of a tilting bathtub system constructed in accordance with the present invention being shown in the substantially horizontal position thereof for use.

Figure 2:
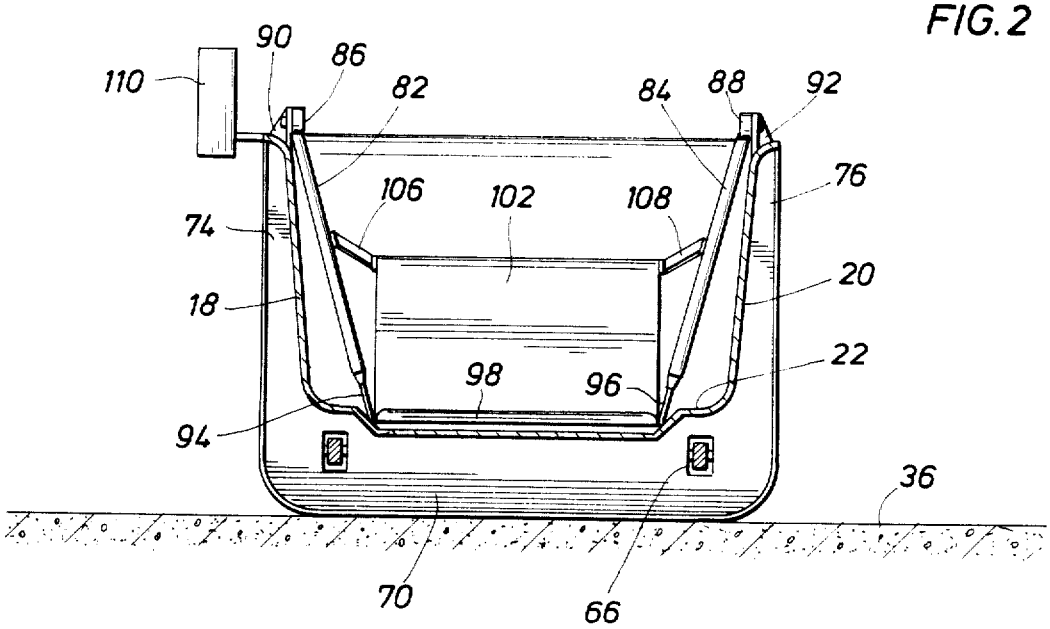

FIG. 2 is a sectional view taken along line 2—2 of FIG. 1.

Figure 3:
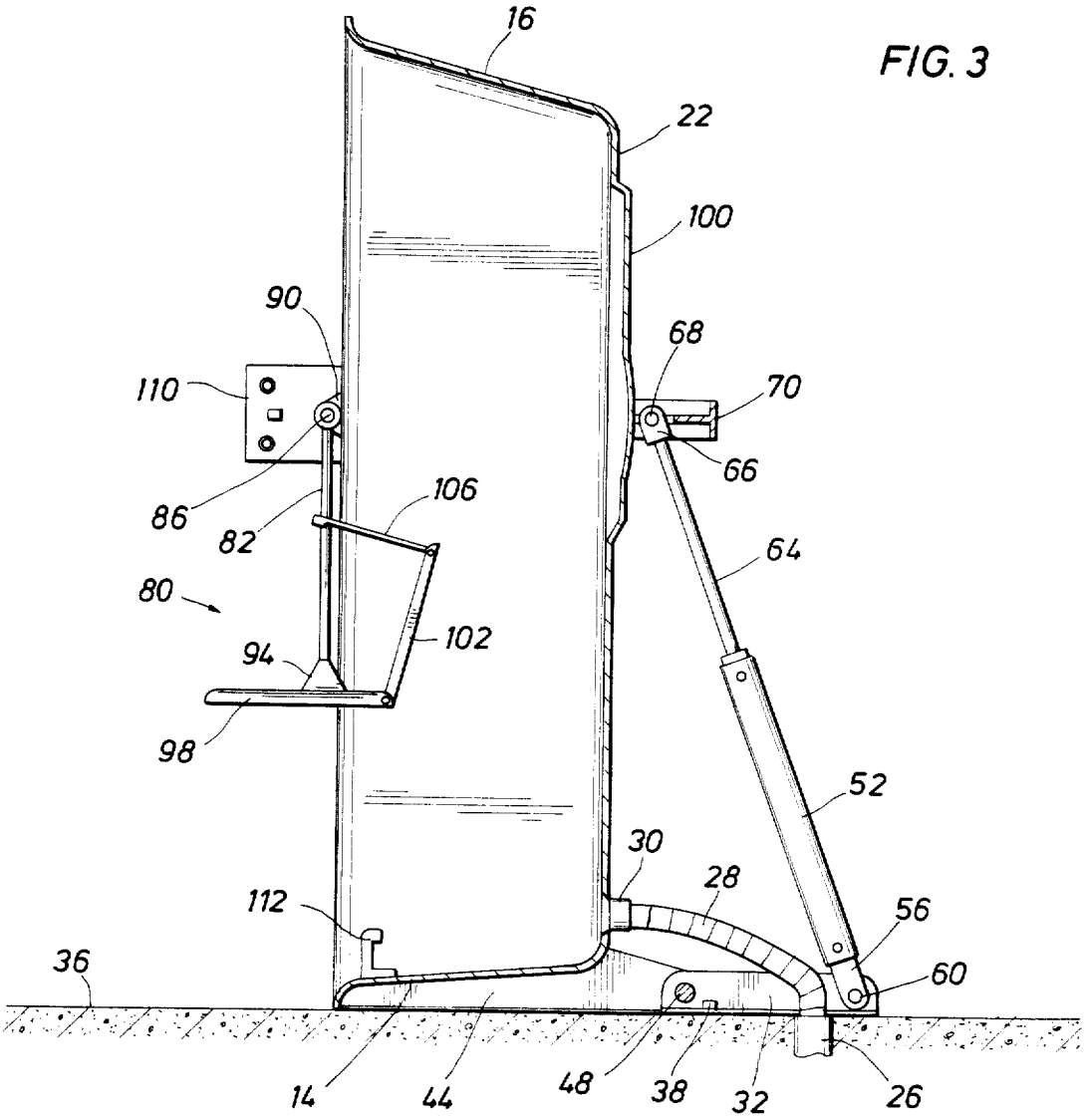

FIG. 3 is a sectional view of the tilting bath system of FIG. 1 showing the bathtub pivoted to its upstanding position for entry or exit by a user person.

Figure 4:
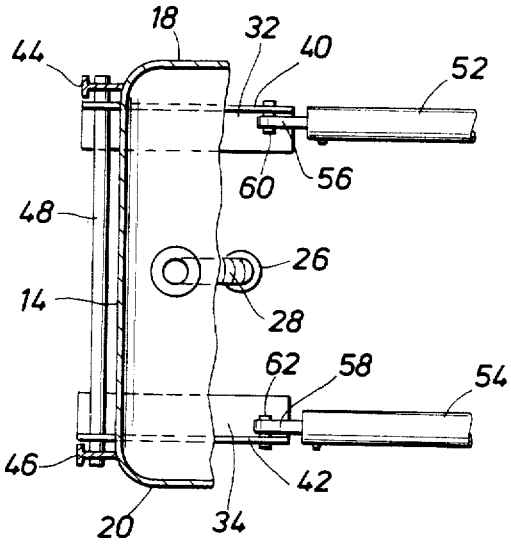

FIG. 4 is a fragmentary sectional view of the tilting bath assembly taken along line 4—4 of FIG. 1 and showing further details of the bath support and operating structure.

DETAILED DESCRIPTION OF PREFERRED EMBODIMENT

Referring now to the drawings and first to FIG. 1, a tilting bath system constructed in accordance with the present invention is shown generally at 10 which incorporates a bathtub shown generally at 12 having end walls 14 and 16, sidewalls 18 and 20 and a bottom wall 22. A drain opening 24 is formed in the bottom wall 22 and is interconnected with a plumbing drain 26 of a building structure by means of a flexible drain conduit 28. The flexible drain 28 incorporates a drain valve 30 which may be electrically or mechanically operated as desired to thus enable it to be opened or closed by a user seated in the bathtub.

For support and stabilization of the tilting bath system within a domestic or commercial building, a pair of support frame members 32 and 34 are secured to a floor structure 36 of the building, such as by a plurality of bolts 38. The support frame members 32 and 34 and in the form of angle members having plates through which the bolts 38 extend for attachment of the supports to the floor structure. The support frame members also include upstanding flange members as shown at 40 and 42 which permit support and operational connection between the support members and the tilting bathtub. At the foot end of the bathtub adjacent the end wall 14, the tub structure incorporates a pair of structural members 44 and 46 having portions thereof which extend to a level below the bottom wall of the bathtub. These extending portions of the structural members 44 define pivot apertures which receive a pivot shaft or pin 48 which also extends through pivot shaft openings 50 in the upstanding flange portions of the support members 32. Thus, the bathtub 12 is mounted for pivotal movement about the pivot pin 48 from a substantially horizontal position shown in FIG. 1 to an upstanding position shown in FIG. 3.

To control movement of the bathtub structure 12 between its substantially horizontal position of FIG. 1 and upstanding position of FIG. 3, a pair of hydraulic cylinders 52 and 54 have connector elements 56 and 58 which receive pivot members 60 and 62 respectively for pivotal connection with the upstanding flange portion of the supports 32 and 34. The hydraulic cylinders incorporate operating rods 64 as shown in FIGS. 1 and 3 having a terminal head portion 66 which is secured by pivots 68 to a support structure 70 secured to the bottom wall of the bathtub intermediate the extremities thereof. In its horizontal position, the support 70 is in supported engagement with the floor 36 or other surface to which the bathtub mechanism is secured. Support structure 70 is in the form of a cradle having side members 74 and 76 which are spaced apart and receive the bathtub sidewalls 18 and 20 in received relation therebetween. The hydraulic cylinders are energized by a hydraulic circuit H, shown schematically in FIG. 1.

It is desirable that the user have the capability of walking to the bathtub and being seated in a safe manner in relation to the bathtub while the bathtub structure is in its upstanding position. It is also desirable that the user be permitted to remain seated during lowering of the bathtub to its horizontal position such that, upon pivotal movement of the bathtub to its horizontal position, the user will be seated at the bottom of the bathtub for use of the tub in normal manner. To accomplish these features, the pivotal bathtub mechanism of this invention is provided with a mobile seat assembly structure illustrated generally at 80. The seat assembly structure incorporates support members 82 and 84 which are secured by pivot members 86 and 88 to pivot support members 90 and 92 which are secured to the upper edges of the sidewalls 18 and 20. The lower portion of the support members 82 and 84 are secured by web connection members 94 and 96 to a chair seat 98. In its lowered or horizontal position as shown in FIG. 2, it is desirable that the chair seat be substantially co-extensive with the bottom wall of the bathtub structure. For this reason, the bottom wall is formed to define a depression 100 into which the seat 98 is positioned when the bathtub is positioned as shown in FIGS. 1 and 2. In such position the upper surface of the seat is substantially co-extensive with the bottom wall 22 of the bathtub.

To permit further efficiency of use, the seat assembly is provided with a pivotal back support 102 which is secured to the seat portion 98 by means of one or more pivots 104. As shown by the arrow in FIG. 1, the back portion 102 of the seat may be lowered into an extended portion of the depression 100 so that the upper surface of the back portion is substantially co-extensive with the bottom surface of the bathtub. In its upstanding position, the seat back 102 is supported by a pair of locking arms 106 and 108 which are pivotally connected to the upper portion of the seat back and are positionable in locked assembly with the support members 82 and 84 as shown in FIGS. 1 and 2.

For operation of the bathtub mechanism between its upstanding and lowered positions, a control panel is provided as shown at 110 in FIGS. 1, 2 and 3 which will permit the user to control the position of the bathtub and, if desired, also control opening and closing of the bathtub drain valve 30 and the bathtub water supply 112. Hot and cold water bathtub supply lines shown schematically at 114 and 116, are flexible to permit tub movement and are provided with electrically operated valves 118 and 120 respectively which are controlled by appropriate manipulation of the control circuitry of the control panel 110.

OPERATION

The mobile bathtub of this invention will ordinarily be in the position shown in FIG. 3, having been exited by a prior user. A subsequent user would walk to the bathtub and become seated in the seat assembly 80 with the seat back 102 locked by bars 106 and 108 in the locked position shown in FIG. 3. In the event the user is not ambulatory, assistants may help the user become seated in the pivotal seat assembly 80. If desired, a safety belt may also be provided to insure that the user remains safely seated during use of the bathtub mechanism. The user will then energize the hydraulic power supply for the cylinder 52 thus causing it to contract toward the FIG. 1 position. When this is done the hydraulic cylinders will force the bathtub to pivot about its pivot 48 from the FIG. 3 position to the FIG. 1 position. During this transition, the pivotal seat assembly 80 functions in gimballike manner to insure that the seat portion 98 remains substantially horizontal, thus providing adequate, safe support for the user during transition of the bathtub from its upstanding position to its horizontal position. During pivotal transition of the bathtub, the user will appropriately actuate the control panel to thus close the water drain valve 30. After reaching the FIG. 1 position of the tub, the user will further actuate the control panel circuitry to open the water supply valves 118 and 120 to thus achieve flow of water into the tub at a temperature desired by the user. In its lowered position, the seat portion 98 of the seat assembly will be positioned in substantially co-extensive relation with the bottom wall 22 of the bathtub. The user may then unlock the back support arms 106 and 108 thereby pivoting the back portion of the seat support structure into the recess 100 of the bottom wall. Thus, the bathtub may be used in conventional manner.

After use, the user will actuate the control panel, thus opening the drain valve 30 and allowing water to drain through the flexible conduit 28 to the drain system 26. The seatback 102 may then be pivoted upwardly and locked in its upstanding position as shown in FIGS. 1, 2 and 3. After the water has drained from the tub, the control circuitry of the panel 110 may be actuated thus energizing the hydraulic system for the hydraulic cylinders 52 and 54. The cylinders will then extend, thus causing the operating rods to pivot the bathtub about the pivot 48 again to the upright position of FIG. 3. In its upstanding position, the user will simply step out of the seat assembly to a standing position and will then be able to walk from the bathtub mechanism.

The novel pivotal bathtub mechanism of this invention provides users with a capability of entering a bathtub and bathing under circumstances where such users might not otherwise be able to step into a conventional bathtub in safe and efficient manner. Further, in its position of use, the bathtub mechanism may be used in the same manner as a conventional bathtub with the user being able to move about to some degree without being hampered by user restraint devices. It is therefore seen that this invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in a limiting sense.

What is claimed is:

1. A movable bathtub mechanism for use by persons with infirmities, comprising:

(a) support means adapted to be secured to the floor of a building structure;

(b) a bathtub being pivotally interconnected at one end thereof with said support means;

(c) a seat structure being pivotally secured to said bathtub said seat structure being presentable in an initial preset sealing position and remaining at said preset position during pivotal movement of siad bathtub;

(d) hydraulically energized linear motor means being interconnected to said support means and said bathtub and being selectively operable to move said bathtub between a horizontal position wherein said bathtub is usable and an upstanding position where said seat structure is positioned to receive a person desiring its use; and (e) a flexible drain tube interconnecting the drain opening of said bathtub with the plumbing drain of the building structure.

2. A movable bathtub mechanism as recited in claim 1 wherein:

(a) second support means is provided intermediate the extremities of the bottom wall of said bathtub and is disposed for supported engagement with said floor, said support means positioning the bottom wall of said bathtub in substantially horizontal manner; and (b) hydraulic cylinder means is secured to said support means and second support means and is operative, upon being energized, to induce pivotal movement of said bathtub between a substantially horizontal position for use and an upstanding position for entry and exit by users.

3. A movable bathtub mechanisms as recited in Claim 1, wherein (a) flexible drain means interconnects the drain opening of said bathtub to the drain system of said building structure; and (b) valve means is provided in said flexible drain means and is selectively operable between open and closed positions by control circuitry means provided in a control panel accessible by the user in both the upstanding and lowered positions of said bathtub.

4. A movable bathtub mechanism as recited in claim 1, wherein:

(a) said bathtub defines a bottom wall forming depression means; and (b) said seat structure having a user seat which remains positioned in substantially horizontal manner during pivotal movement of said bathtub, said user seat being movable into said depression means when said bathtub is positioned in substantially horizontal manner thus positioning said user seat insubstantially co-extensive relation with said bottom wall.

5. A movable bathtub mechanism as recited in claim 4, wherein:

seat back means is pivotally mounted to said user seat and is positionable in upstanding position for support of the back of the user and in lowered position where said seat back is located within said depression means and is positioned in substantially co-extensive relation with said bottom wall.

6. A movable bathtub mechanism as recited in claim 5, wherein:

lock means selectively secures said seat back means in said upstanding position.

7. A movable bathtub mechanism as recited in claim 6, wherein:

said lock means comprises a pair of lock arms pivotally connected to the upper part of said seat back, said lock arms having locking engagement with said seat structure.

* * * * *